US005486658A

United States Patent [19]

Ilkka

[11] Patent Number: 5,486,658

[45] Date of Patent: Jan. 23, 1996

[54] STYLUS DEVICE FOR USE IN A SCUFFING HEAD ASSEMBLY

[75] Inventor: Kenneth E. Ilkka, Clinton Township, Mich.

[73] Assignee: Larry Winget, Leonard, Mich.

[21] Appl. No.: 254,192

[22] Filed: Jun. 6, 1994

[51] Int. Cl.[6] ..... G08C 21/00

[52] U.S. Cl. ..... 178/18; 178/19

[58] Field of Search ..... 178/18, 19, 20; 379/156, 179

[56] References Cited

U.S. PATENT DOCUMENTS

| | | | |
|---|---|---|---|
| 4,473,717 | 9/1984 | Parnell | 178/19 |
| 5,159,321 | 10/1992 | Masaki | 178/18 |
| 5,194,699 | 3/1993 | Zalenski | 178/19 |
| 5,308,936 | 5/1994 | Biggs | 178/18 |

*Primary Examiner*—Stephen Chin
*Assistant Examiner*—Vijay Shankar
*Attorney, Agent, or Firm*—Brooks & Kushman

[57] ABSTRACT

A stylus device includes a lower body portion, an upper body portion, a pair of spaced shoulders, a head supported on the upper body portion between the shoulders and an outwardly extending end surface having a central portion defined by a curve wherein the central portion is rounded for controllably removing a layer of paint from a rotating painted substrate when in engagement therewith. The rounded central portion provides a relatively large amount of pressure per unit area, reduces any danger of gouging the painted substrate, and ensures a smooth, even ride on the painted substrate. The lower body portion is adapted to be removably secured to an attachment part of a scuffing head assembly. The spaced shoulders are formed at a distal end of the upper body portion and each of the spaced shoulders includes an inwardly extending edge. The outwardly extending end surface also includes a pair of spaced rounded end portions which prevent the outwardly extending end surface from damaging the rotating painted substrate at the end portions. The device is preferably formed from a single piece of spring steel so that the stylus device is relatively easy to manufacture in a cost-effective fashion.

15 Claims, 2 Drawing Sheets

STYLUS DEVICE FOR USE IN A SCUFFING HEAD ASSEMBLY

TECHNICAL FIELD

This invention relates to stylus devices for use in scuffing head assemblies and, in particular, to stylus devices for use in scuffing head assemblies which remove a layer of paint from a rotating painted substrate during a test thereof.

BACKGROUND ART

Various procedures are used to determine the resistance to scuffing of materials such as painted substrates, vinyl, leather, and luggage compartment mats. One such test utilizes an abraser manufactured by Teledyne Taber of North Tonawanda, New York. Such an abraser typically includes a specimen holder, a hold down ring, a rubber pad, and a clamp plate. Also, the abraser typically includes scuffing heads such as scuffing head 10 illustrated in FIGS. 1 through 3. As illustrated in the drawing FIGS. 1 through 3, the scuffing head 10 includes a hinged rear arm 12 which is designed to fit over a support 14 for the arm 12 and a wheel 16 of the abraser.

The hinge may be modified for different model abrasers, but when properly located, should position the scuffing head 10 so that it's vertical center line is a predetermined distance from a center pin of the specimen holder and in horizontal alignment with the center pin.

Typically, the painted specimen to be tested is cut from the larger part and conditioned in an air circulating oven having a controlled atmosphere including relative humidity. Then the abraser, including the scuffing head, is adjusted so that the scuffing head is perpendicular to the rotation of the specimen holder. Typically, this means that the scuffing head is placed on the abraser in place of wheels and weights normally used with the abraser. A weight is then placed on the scuffing head assembly. Then the abraser scuffs the test specimen for a predetermined number of cycles. After the predetermined number of cycles, the specimen is removed from the abraser and the arcs on the specimen that have paint removed therefrom are measured. From this measurement, the percent paint which is removed by the scuffing head is calculated. In this way, the resistance of paint to be removed from the substrate material is determined in a quantitative fashion.

The prior art scuffing heads such as the scuffing head 10 illustrated in FIGS. 1–3 have a number of disadvantages associated therewith. For example, for many specimens, a relatively large amount of weight must be used to bias the scuffing head against the rotating substrate in order to properly test the painted substrate. Also, because it is typically not possible to perfectly align the scuffing head relative to the rotating substrate, there is a danger of gouging the painted substrate as it rotates since the scuffing head may have a tendency to ride up on its edge. Also, the scuffing head of FIGS. 1–3 may not ride evenly on the surface of the rotating substrate due to misalignment between the scuffing head and the rotating substrate.

Another problem associated with such prior art scuffing heads is the expense associated with manufacturing a scuffing head such as the scuffing head 10 of FIGS. 1–3.

SUMMARY OF THE INVENTION

An object of the present invention is to provide a relatively simple stylus device for use in a scuffing head assembly wherein the stylus device: (1) provides a relatively large amount of pressure per unit area on a rotating substrate, (2) substantially eliminates any danger of gouging the rotating specimen and (3) provides a relatively smooth, even ride on the rotating specimen.

Another object of the present invention is to provide a stylus device for use in a scuffing head assembly wherein the stylus device is relatively easy to manufacture in a cost-efficient fashion.

In carrying out the above objects and other objects of the present invention, a stylus device is provided for use in a scuffing head assembly having an attachment part. The device includes a lower body portion adapted to be removably secured to the attachment part, an upper body portion extending from the lower body portion, and a pair of spaced shoulders formed at a distal end of the upper body portion. Each of the shoulders includes an inwardly extending side surface defined by a curve having a first radius. The device further includes a head supported on the upper body portion between the shoulders. The head includes an outwardly extending end surface having a central portion defined by a curve having a second radius. The central portion of the outwardly extending end surface is rounded for controllably removing a layer of paint from a rotating painted substrate when in engagement therewith.

Preferably, the lower body portion lies in a first plane and the upper body portion, including the shoulders and the head, lie in a second plane which intersects the first plane at an angle in a range of 100 degrees to 120 degrees.

Also preferably, the outwardly extending end surface also has a pair of spaced end portions. Each of the end portions is defined by a curve having a third radius wherein the length of the second radius is in the range of 9–11 times the length of the third radius. The end portions of the outwardly extending end surface are also rounded to prevent the outwardly extending end surface from damaging the rotating substrate at the end portions thereof.

Still further, preferably, the device is formed from a single piece of spring steel.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
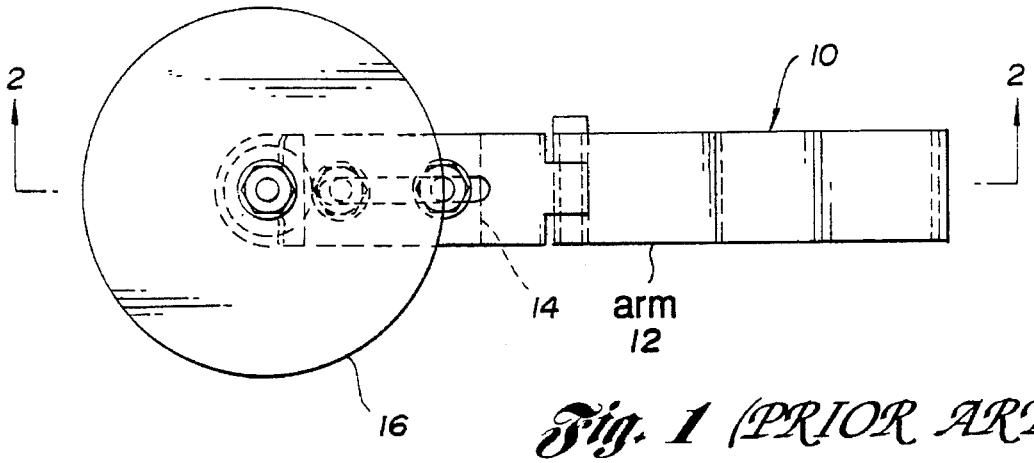
Fig. 1 (PRIOR ART)
FIG. 1 is a top plan view of a prior art scuffing head assembly.
Figure 2:
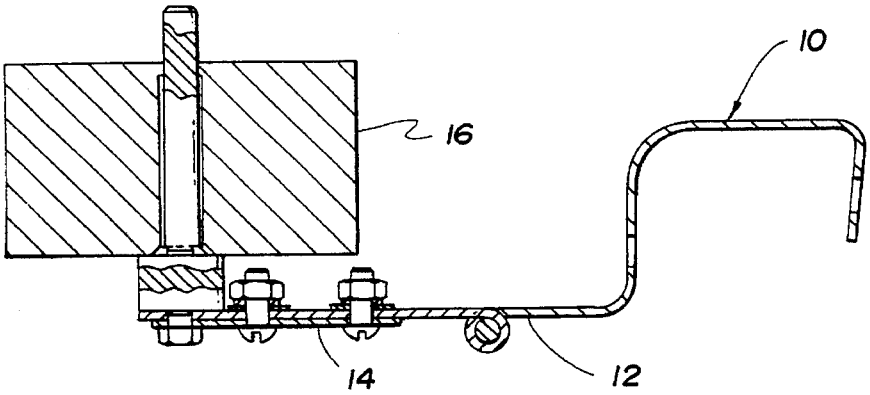
Fig. 2 (PRIOR ART)
FIG. 2 is a sectional view taken along lines 2—2 of FIG. 1 of the prior art scuffing head assembly.
Figure 3:
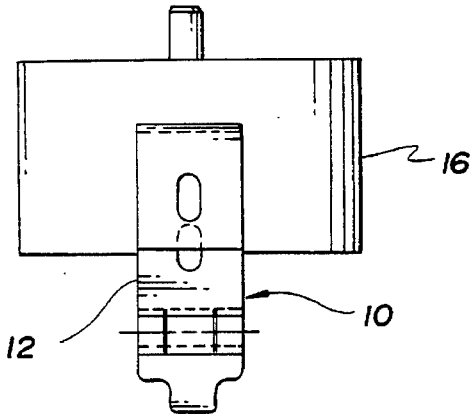
Fig. 3 (PRIOR ART)
FIG. 3 is an end view of the prior art scuffing head assembly.
Figure 4:
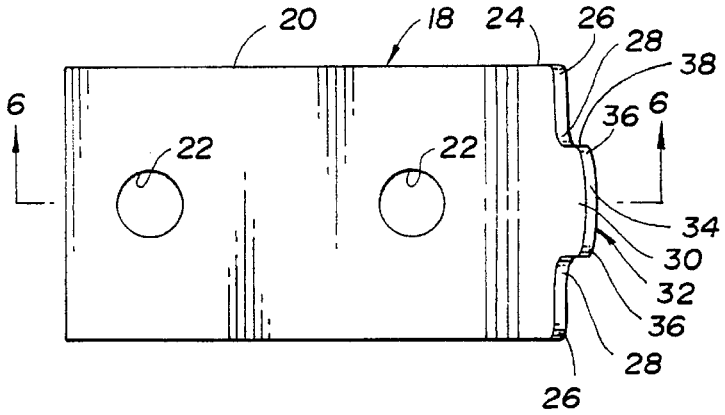
FIG. 4 is a plan view of a stylus device for use in a scuffing head assembly constructed in accordance with the present invention.

Referring now to the drawing FIGS. 4–8, there is illustrated a stylus device, generally indicated at 18, for use in a scuffing head assembly having an attachment part. The device 18 includes a lower body portion 20 which is adapted to be removably secured to the attachment part of the scuffing head assembly by means of holes 22. The device 18 also includes an upper body portion 24 which extends from the lower body portion 20.

The device 18 further includes a pair of spaced shoulders 26 formed at a distal end of the upper body portion 24. Each of the shoulders 26 includes an inwardly extending side surface 28 defined by a curve having a first radius.

The device 18 also includes a head 30 supported on the upper body portion 24 between the shoulders 26. The head 30 includes an outwardly extending end surface, generally indicated at 32, having a central portion 34 defined by a curve having a second radius. The central portion 34 of the outwardly extending end surface 32 is rounded for controllably removing a layer of paint from a rotating painted substrate when in engagement therewith.

Figure 5:
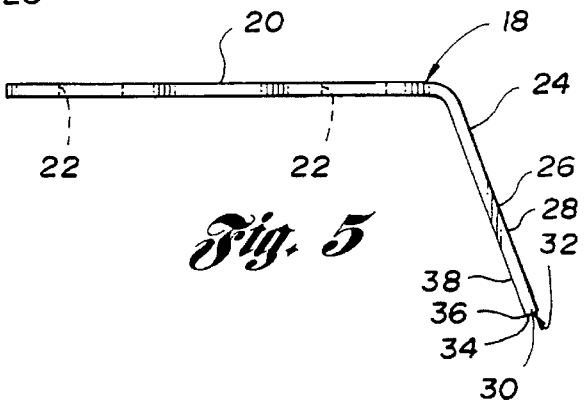
FIG. 5 is a side elevational view of the stylus device of FIG. 4.
Figure 6:
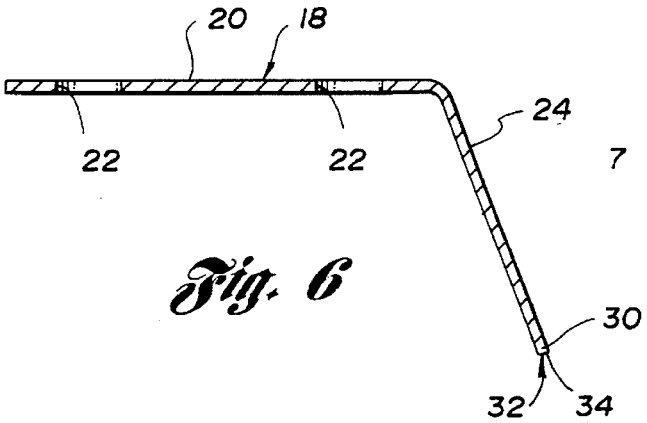
FIG. 6 is a sectional view taken along lines 6—6 of FIG. 4.

As best illustrated in FIGS. 5 and 6, the lower body portion 20 lies in a first plane and the upper body portion 24 including the shoulders 26 and the head 30, lie in a second plane, which intersects the first plane at an angle in the range of 100 degrees to 120 degrees. Preferably, this angle is approximately 110 degrees. This size angle applies the most pressure to a test panel without "digging into" the test panel.

The length of the second radius of the curve which defines the central portion 34 is in the range of 2–4 times larger than the length of the first radius of the curve which defines the inwardly extending side surfaces 28 of the shoulders 26. Preferably, the length of the second radius is approximately 3 times the length of the first radius.

The outwardly extending end surface 32 also includes a pair of spaced end portions 36. The end portions 36 are also rounded to prevent the outwardly extending end surface 32 from damaging the rotating painted substrate at the end portions 36 thereof. This is important especially during misalignment between the device 18 and the substrate.

Each of the end portions 36 is defined by a curve having a third radius wherein the length of the second radius is in the range of 9–11 times the length of the third radius. Preferably, the length of the second radius is approximately 10 times the length of the third radius.

Figure 7:
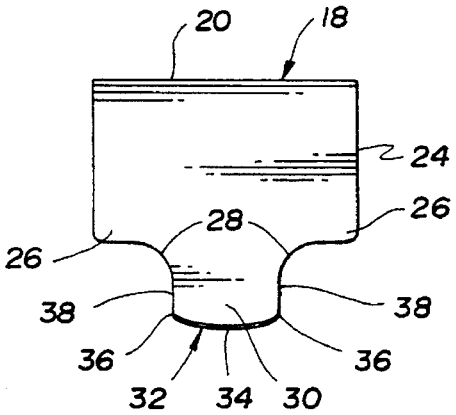
FIG. 7 is an end view taken in the direction of arrow 7 of FIG. 6.
Figure 8:
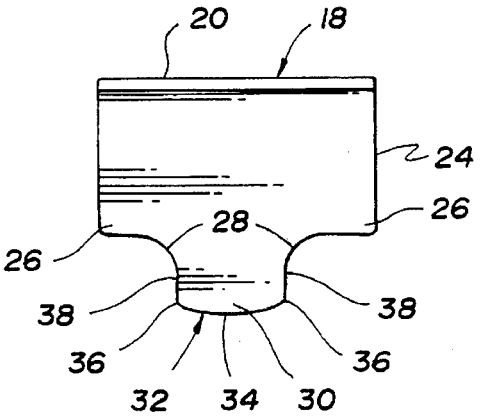
FIG. 8 is a rear view of the stylus device of FIG. 6.

The head 30 also includes a pair of spaced parallel side surfaces 38, as best shown in FIGS. 7–8. Each of the spaced parallel side surfaces 38 is formed between and interconnects one of the inwardly extending side surfaces 28 and one of the rounded end portions 36 of the outwardly extending end surface 32.

The stylus device 18 is preferably formed from a single piece of spring steel. In particular, the stylus device 18 is preferably formed from SAE 1065 spring steel which, after it is bent, is hardened and quenched to a Rockwell C 60 minimum temper at 350° F. Also preferably, the thickness of the single piece of spring steel is approximately 0.035 inches.

While the best mode for carrying out the invention has been described in detail, those familiar with the art to which this invention relates will recognize various alternative designs and embodiments for practicing the invention as defined by the following claims.

What is claimed is:

1. A stylus device comprising:

a lower body portion;

an upper body portion extending from the lower body portion;

a pair of spaced shoulders formed at a distal end of the upper body portion, each of the spaced shoulders including an inwardly extending side surface defined by a curve having a first radius; and a head supported on the upper body portion between the spaced shoulders and including an outwardly extending end surface having a central portion defined by a curve having a second radius, the central portion of the outwardly extending end surface being rounded for controllably removing a layer of paint from a rotating painted substrate when in scuffing engagement therewith.

2. The device as claimed in claim 1 wherein the lower body portion lies in a first plane and the upper body portion, including the spaced shoulders and the head, lie in a second plane which intersects the first plane at an angle in a range of 100 degrees to 120 degrees.

3. The device as claimed in claim 2 wherein the angle is approximately 110 degrees.

4. The device as claimed in claim 1 wherein a length of the second radius is in the range of two to four times larger than a length of the first radius.

5. The device as claimed in claim 4 wherein the length of the second radius is approximately three times the length of the first radius.

6. The device as claimed in claim 1 wherein the outwardly extending end surface also has a pair of spaced end portions, each of the end portions being defined by a curve having a third radius and wherein the length of the second radius is in the range of nine to eleven times a length of the third radius and the end portions of the outwardly extending end surface are also rounded to prevent the outwardly extending end surface from damaging the rotating painted substrate at the end portions.

7. The device as claimed in claim 6 wherein the length of the second radius is approximately ten times the length of the third radius.

8. The device as claimed in claim 6 wherein the head further includes a pair of spaced parallel side surfaces, each of the spaced parallel side surfaces being formed between and interconnecting one of the inwardly extending side surfaces and one of the rounded end portions of the outwardly extending end surface.

9. The device as claimed in claim 1 wherein the stylus device is formed from a single piece of spring steel.

10. A stylus device being formed from a single piece of spring steel and comprising:

a lower body portion;

an upper body portion extending from the lower body portion;

a pair of spaced shoulders formed at a distal end of the upper body portion, each of the spaced shoulders including an inwardly extending side surface defined by a curve having a first radius; and a head supported on the upper body portion between the spaced shoulders and including an outwardly extending end surface having a central portion defined by a curve having a second radius, the central portion of the outwardly extending end surface being rounded for controllably removing a layer of paint from a rotating painted substrate when in scuffing engagement therewith, wherein the lower body portion lies entirely in a first plane and the upper body portion, including the spaced shoulders and the head, lie entirely in a second plane which intersects the first plane at an angle in a range of 100 degrees to 120 degrees.

11. The device as claimed in claim 10 wherein the angle is approximately 110 degrees.

12. The device as claimed in claim 10 wherein a length of the second radius is in the range of two to four times larger than a length of the first radius.

13. The device as claimed in claim 12 wherein the length of the second radius is approximately three times the length of the first radius.

14. A stylus device being formed from a single piece of spring steel and comprising:

a lower body portion;

an upper body portion extending from the lower body portion;

a pair of spaced shoulders formed at a distal end of the upper body portion, each of the spaced shoulders including an inwardly extending side surface defined by a curve having a first radius; and a head supported on the upper body portion between the spaced shoulders and including an outwardly extending end surface having a central portion defined by a curve having a radius, the central portion of the outwardly extending end surface being rounded for controllably removing a layer of paint from a rotating painted substrate when in scuffing engagement therewith, wherein the outwardly extending end surface also has a pair of spaced end portions, each of the end portions being defined by a curve having a third radius wherein the length of the second radius is in the range of nine to eleven times a length of the third radius and the end portions of the outwardly extending end surface are rounded to prevent the outwardly extending end surface from damaging the rotating painted substrate at the end portions, and wherein the head further includes a pair of spaced parallel side surfaces, each of the spaced parallel side surfaces being formed between and interconnecting one of the inwardly extending side surfaces and one of the rounded end portions of the outwardly extending end surfaces.

15. The device as claimed in claim 14 wherein the length of the second radius is approximately ten times the length of the third radius.

* * * * *